US006717344B1

(12) United States Patent
Cosma et al.

(10) Patent No.: US 6,717,344 B1
(45) Date of Patent: Apr. 6, 2004

(54) CATHODE-RAY TUBE HAVING A MULTIFUNCTION FRAME/MASK SUPPORT

(75) Inventors: Pedro Eugenio Cosma, Rome (IT); Carlo Tulli, Rome (IT)

(73) Assignee: Videocolor S.p.A., Fratta Rotonda (IT)

( * ) Notice: Subject to any disclaimer, the term of this patent is extended or adjusted under 35 U.S.C. 154(b) by 238 days.

(21) Appl. No.: 09/616,655

(22) Filed: Jul. 14, 2000

(30) Foreign Application Priority Data

Jul. 16, 1999 (IT) ..... MI99A1584

(51) Int. Cl.[7] ..... H01J 29/80
(52) U.S. Cl. ..... 313/407; 313/402; 313/404
(58) Field of Search ..... 313/402–408

(56) References Cited

U.S. PATENT DOCUMENTS 3,873,875 A * 3/1975 Miller ..... 313/405
3,962,598 A 6/1976 Schneider, Jr. ..... 313/406
3,986,072 A 10/1976 Adamski ..... 313/404
4,164,682 A * 8/1979 Palac ..... 313/404
4,847,532 A * 7/1989 Rath ..... 313/407
5,214,349 A * 5/1993 Sakata et al. ..... 313/348
5,982,085 A * 11/1999 Lakshmanan et al. ..... 313/402
2001/0040425 A1 * 11/2001 Ha et al. ..... 313/407

* cited by examiner

*Primary Examiner*—Nimeshkumar D. Patel
*Assistant Examiner*—German Colon
(74) *Attorney, Agent, or Firm*—Joseph S. Tripoli; Joseph J. Laks; Carlos M. Herrera

(57) ABSTRACT

A cathode-ray tube comprises a color-selection frame/mask assembly, the mask being held under tension by being welded onto the ends of the long sides of the frame, the frame/mask assembly being suspended within the tube with the aid of supports capable of serving to augment the mechanical rigidity of the sides onto which these supports are welded and to cause the long sides of the frame to approach closer to each other during the phases of manufacture at high temperature.

9 Claims, 3 Drawing Sheets

CATHODE-RAY TUBE HAVING A MULTIFUNCTION FRAME/MASK SUPPORT

The invention relates to a color cathode-ray tube, and, more particularly, to a system for suspending a color-selection frame/mask device arranged inside the glass bulb of a tube. The invention finds an application in any type of tube including support of a color-selection mask therein, and is more particularly suitable for tubes in which a mask is held under tension by a frame to which it is secured.

BACKGROUND OF THE INVENTION

Conventional cathode-ray tubes include a color-selection mask situated at a precise distance from the inside of the glass front face of the tube, on which front face arrays of red, green and blue phosphors are deposited. Under the influence of three electron beams, each corresponding to a defined primary color, the arrays of phosphors allow images to be reproduced on the screen, the mask allowing each defined beam to illuminate only the phosphor of the corresponding color.

The color-selection mask should be arranged and held in a precise position within said tube, while the tube is operating. The holding functions are carried out by virtue of a generally very rigid rectangular metal frame to which the mask is conventionally welded. The frame/mask assembly is mounted in the front face of the tube by virtue of suspension means, including at least three metal pieces welded to the frame, each of said pieces including one end forming a spring and pierced with an aperture intended to engage one of the metal pins included in the glass front face. Two arrangements of the suspension means are conventionally used, either at the middle of the sides of the frame, or at the corners thereof.

The current trend is to produce tubes with increasingly flatter front faces, eventually evolving to become completely flat front faces. In order to produce tubes including such a front face, one technology consists in using a flat mask, held under tension in at least one direction. Such structures are described, for example, in U.S. Pat. 5,111,107 However, in order to maintain the flatness of the mask, a high tensile force has to be applied to it and the structure of the frame, which is required, and is heavy, using up a large amount of material. The present invention proposes to lighten the structure of the frame holding a mask under tension while reducing the number of metal pieces of the structure by using reinforcing pieces also acting as a means of support for the frame/mask system.

SUMMARY OF THE INVENTION

A color cathode-ray tube according to the present invention comprises a glass front face on which is deposited a screen of luminescent materials, a color-selection mask arranged close to the screen, and a frame to which the mask is fixed and which holds it under tension along at least one direction. The frame has a substantially rectangular shape defined by a pair of opposed long sides and a pair of likewise opposed short sides. At least two sides each include an edge in the form of a metal plate substantially parallel to the surface of the mask, the frame/mask assembly being held within the front face by support means interacting with pins fixed into the thickness of the front face. At least two support means each incorporate a metal piece including a first part extending over one of the surfaces of the plate. The first part is secured, for example by welding, to the plate. A second part extends in a direction substantially perpendicular to the surface of the mask.

DESCRIPTION OF THE PREFERRED EMBODIMENT

Figure 6:
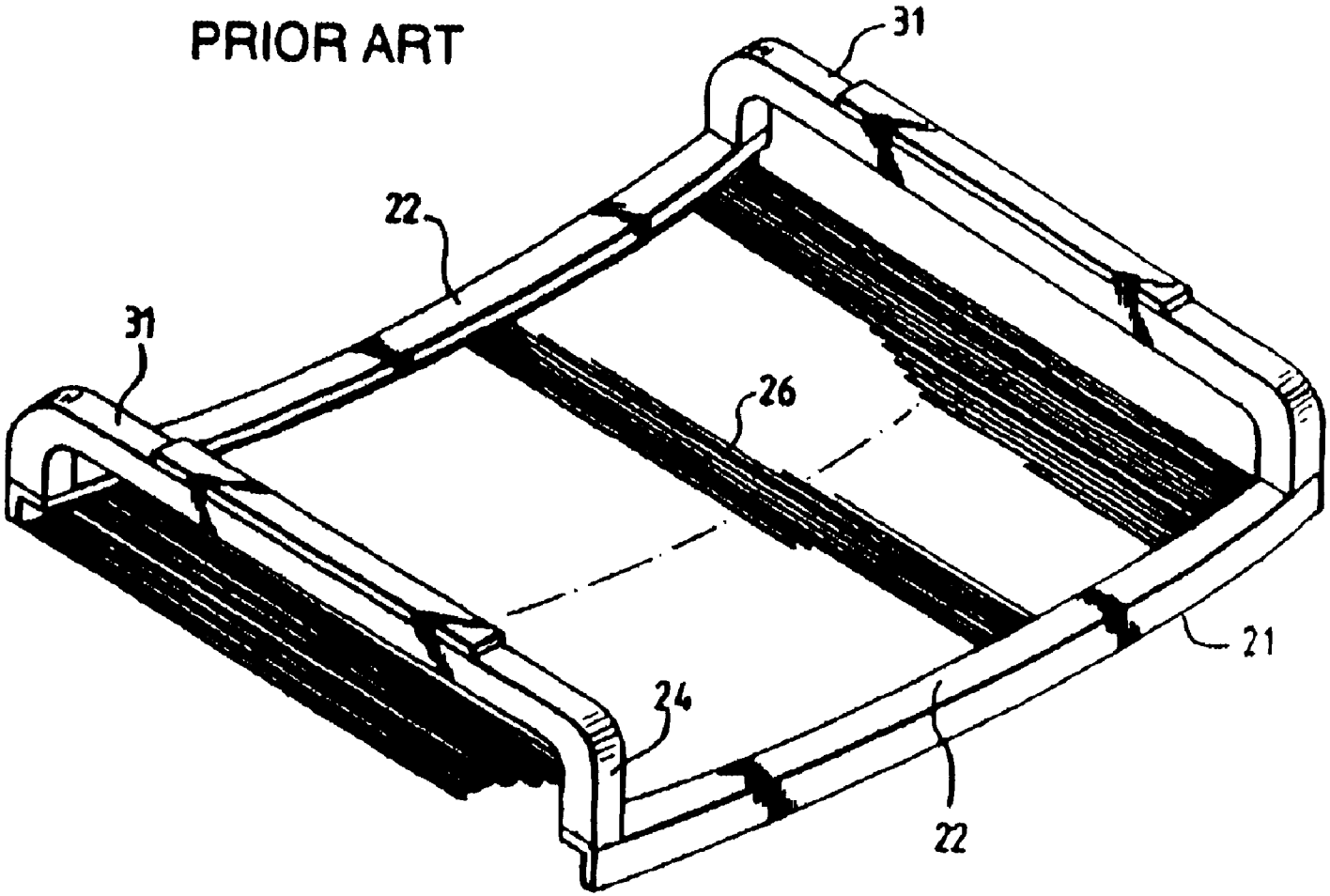
FIG. 6 PRIOR ART
FIG. 6 is a frame/mask assembly according to the prior art, as seen in perspective.

As described by FIG. 6, a prior art frame 21 for a tensioned mask 26 comprises two long sides 22, onto which the mask is welded. Two U-shaped short sides 31 have to maintain mask tension during manufacture of the tube and during normal tube operation. In order to maintain this tension, the frame has to consist of profiles with substantial cross section, which introduces two major drawbacks:

- substantial weight, which is particularly apparent in the case of tubes with a large screen dimension, for example greater than 70 cm in diagonal;
- use of a large amount of material, which has a major impact on the overall cost of the tube, especially if the frame is manufactured from an expensive material such as Invar, in order to minimize the phenomenon of thermal expansion.

Figure 1:
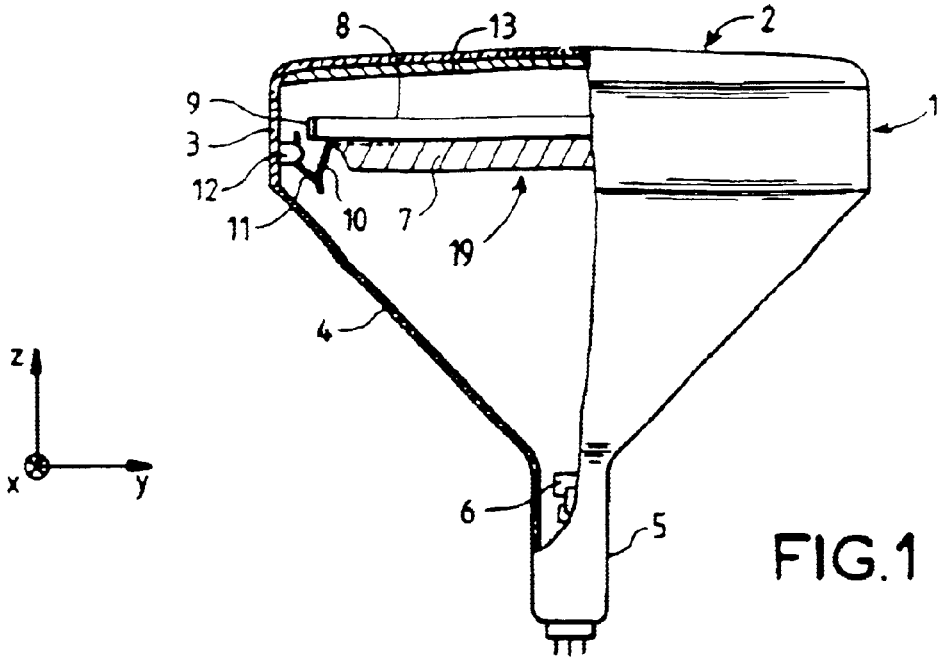
FIG. 1 represents a cathode-ray tube according to the invention seen partly in exploded view.

As illustrated by FIG. 1, a cathode-ray tube 1 according to the invention comprises a substantially flat faceplate 2 and a peripheral skirt 3. The faceplate is bonded to a funnel-shaped part of the tube 4 by virtue of a sintered-glass seal. The end part of the tube or neck 5 surrounds an electron gun 6. Electron beams from the gun illuminate a screen 13 of luminescent phosphors after passing through a color-selection mask 8. The mask 8 is flat, tensioned between the long sides 9 of a frame 19. Metal supports for the frame/mask assembly hold this assembly within the tube. The supports include a part 10 welded to the frame and a part forming a spring 11. The spring includes an aperture that engages a pin 12 included in the glass skirt 3.

Figure 4:
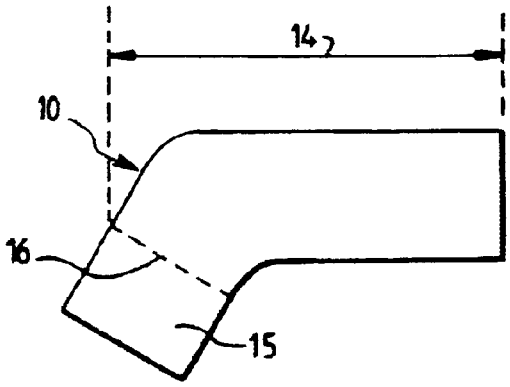
FIG. 4 shows a frame/mask support according to the invention in detail.
Figure 2:
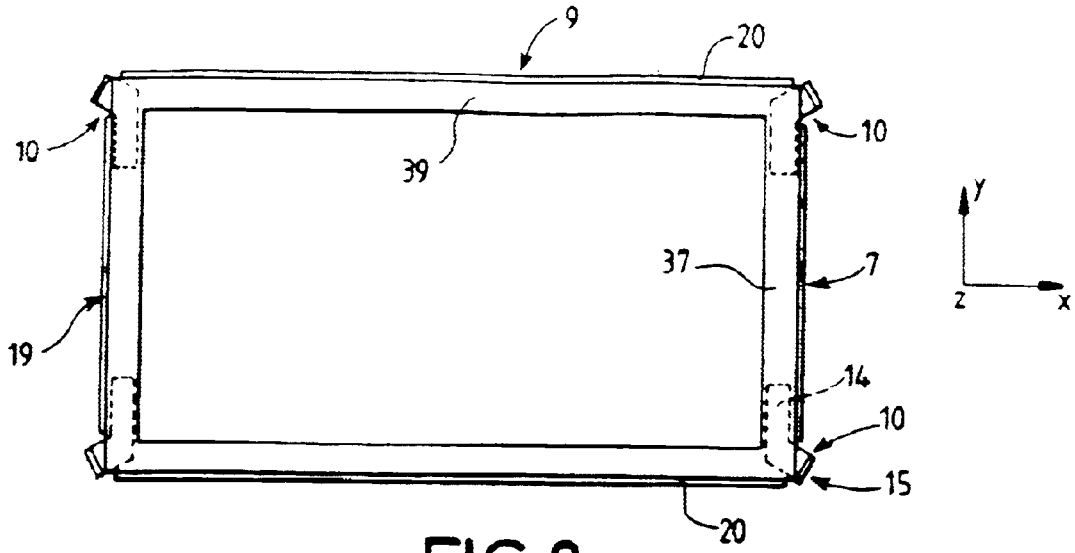
FIG. 2 represents a frame according to the invention in a top view.
Figure 3:
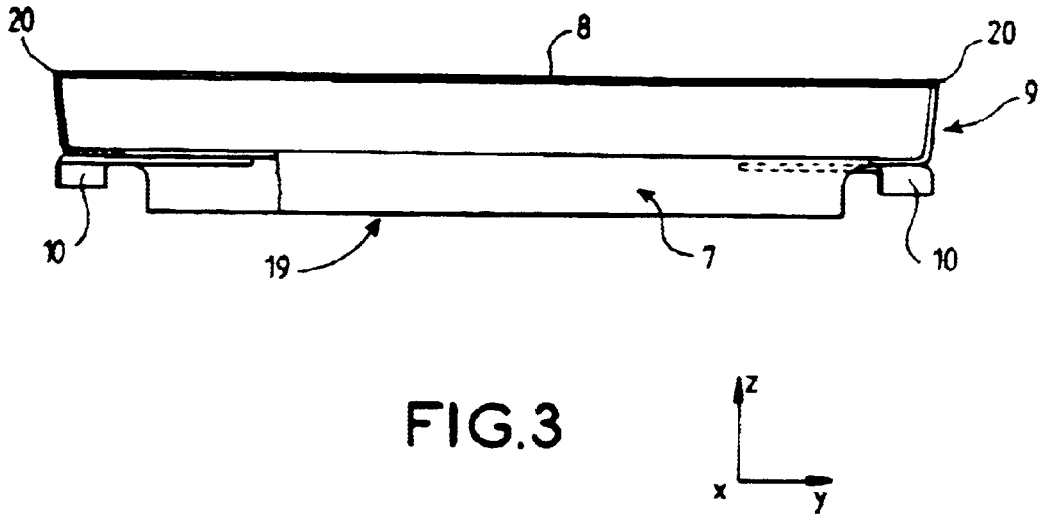
FIG. 3 illustrates a frame/mask according to the invention in a side, partially exploded, view.

In the embodiment example illustrated by FIGS. 2, 3, and 4, the frame 19, of 16/9 format, comprises a pair of short sides 9 and a pair of long sides 97. The long and short sides have, for example, L-shaped cross-sections and flat parts 37, 39, respectively, substantially parallel to the surface of the mask, which the frame is intended to hold under tension. With the mask 8 being held under tension by being welded to the end 20 of the long sides of the frame, mechanical tension on the mask is maintained by the short sides which have to have sufficient rigidity.

It is therefore possible to use a frame which is appreciably lightened by comparison with the prior art, for example by using slender profiled sections, the mechanical rigidity being provided by the addition of pieces 10 acting as reinforcement wherever necessary, such as along the short sides. As in the example embodiments of FIGS. 2, 3, 4, the frame, with a diagonal equal to 76 cm, is produced from Invar with a material thickness equal to about 1.5 mm. The reinforcing pieces 10 are arranged at the four corners of the frame and have a portion 14 extending over one of the surfaces of the flat part 37 to which this portion 14 is secured, for example by welding. These reinforcing pieces 10 are made of Invar and have a thickness identical to that of the frame. The portions 14 each have a length of about 8 cm and therefore cover about 40% of each of the short sides 7.

The invention moreover exhibits other technical advantages. The pieces 10, as illustrated by FIGS. 2, 3, and 4 may serve as a support for the frame/mask assembly by having each piece 10 include a second portion 15 which, after folding about an intermediate region 16, will lie in a direction substantially perpendicular to the surface of the mask 8. On the portion 15, it is possible, in a conventional way, to weld a spring pierced with an aperture intended to receive a pin set into the skirt 3 of the front panel of the tube. In this way, it is possible to reduce the number of metal pieces used, since the pieces 10 participate in the mechanical reinforcement of the short sides of the frame and serve as support for the frame/mask assembly.

Moreover, it is known that, during tube manufacturing, the frame/mask assembly undergoes heat treatment at temperatures of the order of 450° C. However, because of its low mass, the mask behaves mechanically in a different way than the frame during the stages of the tube manufacturing process. For example, after the oxidation stage, the frame/mask assembly is brought back to ambient temperature, but the mask, having very low thermal inertia by comparison with the frame, cools down more quickly than the frame. The tension in the mask will therefore, during the transient phase of cooling of the frame, be much higher than when the two elements have reached the same temperature. Depending on the tension initially applied to the mask and the type of material constituting the said mask, the mask may be taken, during these transient phases, beyond its limit of elasticity, and permanent deformation of the mask will ensue, rendering further use impossible. This is because the tension in the mask when the tube is in operation will no longer be sufficient, and any mechanical vibration, produced by the loudspeakers of the television set in which the tube is installed, for example, will generate vibration of the mask causing discoloration of the image.

In this context, reinforcing pieces 10 may be used to afford a solution to the above-described problem. To do that, the reinforcing pieces 10 are produced from a material having a coefficient of thermal expansion different from that of the frame.

In the case in which these pieces 10 are made of N42 iron/nickel alloy having a thermal expansion coefficient three times higher than that of Invar, the frame itself being made of Invar, the portions 14 of the reinforcing pieces 10 are welded to the short sides of the frame, on the surface of the flat part 37 opposite of the surface of the mask. In this way during a substantial rise in temperature of the frame/mask assembly, the pieces 10 will expand more than the sides of the frame onto which they are welded. This results in a curved deformation of these sides, lending to cause the ends 20 of the long sides, onto which the mask is welded, to approach closer to each other, as shown in phantom in FIG. 3. This approaching movement will cause a weakening of the tension in the mask by comparison to that defined in the steady-state regime and to that during the stages of the manufacturing process taking place at high temperature. Consequently, during the transient cooling phases, the mask will no longer be subjected to high tensile forces, possibly causing permanent deformation.

Another advantage of the above-described device relating to the use of support pieces having a thermal expansion coefficient differing from that of the frame lies in the fact that these pieces may contribute, during the normal operation of the tube, to maintaining color purity. As described in U.S. Pat. No. 4,827,180, when the tube lights up, a period of heating of the frame/mask assembly occurs, which may cause discoloration of the image formed on the screen of the tube. This discoloration is due to the fact that, during the transient heating period, with the frame expanding progressively, for example along the horizontal axis, it is necessary to impart a slight movement to the mask toward the screen so that the electron beams illuminate the corresponding rows of phosphors. The temperature rises are very much less than those registered (here they are of the order of a few tens of degrees by comparison with ambient temperature) during the stages of the tube manufacturing process, but they are sufficient to induce a loss of color purity on the screen, of the tube. In order to alleviate this effect, the frame/mask assembly is shifted with respect to the screen during the transient phase, by the curvature of the short sides of the frame induced by the difference in expansion of the pieces 10 and of the short sides.

Figure 5:
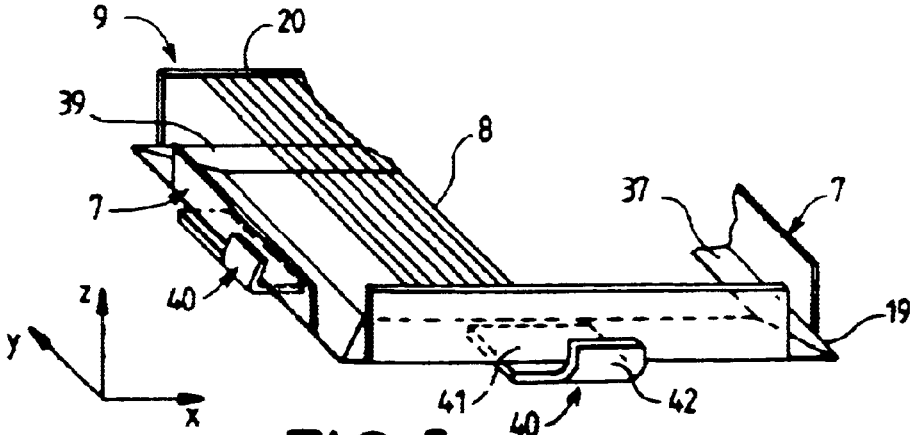
FIG. 5 illustrates a second embodiment of the invention.

In another embodiment illustrated by FIG. 5, supports 40, intended for reinforcing the short sides and for providing the support for the frame/mask assembly, are two in number and are welded to a region situated substantially in the middle of the said short sides 7. These supports 40 have a structure which is identical to the means 10 in the sense that they include a first portion 41 extending over one of the surfaces of parts 37, parallel to the mask, of each short side 7 and of a second portion 42 extending in a direction substantially perpendicular to the surface of the mask.

In addition to their function of mechanical reinforcement and support of the frame/mask assembly, these supports 40 may carry out the function of reducing the tension in the mask during the stages of the manufacturing process which are carried out at high temperature, and in the same way as the means or reinforcing pieces 10, by using constituent materials having a thermal expansion coefficient differing from that of the frame.

For reasons of reducing the number of different metal pieces to be managed in manufacturing the tube, and thereby of reducing the manufacturing costs, the supports of the frame/mask may all be identical. Hence, three or four supports identical to the supports 40 may be used to support the same frame.

The above examples are not limiting; for example, in another embodiment which is not represented, with the frame/mask being supported at the corners, the reinforcing and support means consist of two pieces, each piece including a first part extending all along one surface of the short side parallel to the mask, and two ends extending in a direction substantially perpendicular to the surface of the mask, these ends possibly serving as a support as in the embodiments described above.

What is claimed is:

1. A color cathode-ray tube having a glass faceplate on which is deposited a screen of luminescent materials, a color-selection mask arranged close to the screen, a frame to which the mask is fixed and which holds it under tension along a tension direction, said frame being of a substantially rectangular shape defined by a pair of opposed long sides and a pair of likewise opposed short sides, at least two sides each include an edge in the form of a metal part substantially parallel to the surface of the mask, the mask/frame assembly being held within the faceplate by support means engaging pins fixed to the faceplate, the support means, comprising:

a metal piece including a first portion secured by welding to the metal part, said first portion attached opposite a surface of the mask and extending in a direction parallel to the tension direction of the mask, and a second portion extending in a direction substantially perpendicular to the first portion for securing the frame to the glass faceplate, said metal part and said support means having coefficients of thermal expansion that cause the sides having the first portion to deform when heated such that ends of the sides not having the first portion approach each other to reduce the tension in the mask during heating.

2. The cathode-ray tube as defined in claim 1, wherein the first portion is arranged at an end of the frame.

3. The cathode-ray tube as defined in claim 1, wherein the mask is held under tension between the long sides of the frame.

4. The cathode-ray tube as defined in claim 3, wherein the sides including an edge in the form of a metal part substantially parallel to the surface of the mask are the short sides of the frame.

5. The cathode-ray tube as defined in claim 1, wherein the coefficients of thermal expansion of the materials constituting the frame and the support means are different.

6. The cathode-ray tube as defined in claim 5, wherein the coefficients of thermal expansion of the metal piece of the support means is higher than that of the edges of the frame onto which it is welded.

7. The cathode-ray tube as defined in claim 1, which includes four support means each incorporating a metal piece.

8. The cathode-ray tube as defined in claim 1, wherein two opposing sides of the frame each have two supporting means attached thereto, the first portions of the supporting means covering about forty percent of each of the sides of the frame.

9. The cathode-ray tube as defined in claim 1, wherein the frame is of one-piece construction such that the entire frame expands and contracts as one unit during heating.

* * * * *